United States Patent [19]

Magnenet

[11] Patent Number: 4,657,416

[45] Date of Patent: Apr. 14, 1987

[54] NON-IMPACT PRINTING APPARATUS

[75] Inventor: Jean Magnenet, Chaux, France

[73] Assignee: Cii Honeywell Bull (Societe Anonyme), Paris, France

[21] Appl. No.: 811,385

[22] Filed: Dec. 20, 1985

[30] Foreign Application Priority Data

Dec. 20, 1984 [FR] France ..... 84 19511

[51] Int. Cl.[4] ..... B41J 3/02

[52] U.S. Cl. ..... 400/119; 346/153.1; 101/DIG. 13; 430/120; 118/657

[58] Field of Search ..... 400/119; 101/DIG. 13, 101/1; 346/153.1, 155, 74.2, 74.5; 430/39, 48, 107, 120, 122; 355/3 TE, 3 TR; 118/623, 653, 657

[56] References Cited

U.S. PATENT DOCUMENTS

| | | | |
|---|---|---|---|
| 3,601,091 | 8/1971 | Preckshot | 430/39 |
| 3,684,075 | 8/1972 | Staller et al. | 400/119 |
| 3,703,157 | 11/1972 | Maksymiak | 430/120 |
| 3,735,416 | 5/1973 | Ott et al. | 346/74.2 |
| 4,038,665 | 7/1977 | Neukermans | 346/74.2 |
| 4,051,484 | 9/1977 | Martin | 400/119 |
| 4,093,367 | 6/1978 | Eichorn | 346/153.1 X |
| 4,114,536 | 9/1978 | Kaneko et al. | 346/153.1 X |
| 4,452,173 | 6/1984 | Tabuchi et al. | 118/657 X |
| 4,468,681 | 8/1984 | Wako et al. | 346/153.1 |
| 4,553,149 | 11/1985 | Yano | 346/153.1 |
| 4,571,060 | 2/1986 | Bares | 430/120 |

FOREIGN PATENT DOCUMENTS

| | | | |
|---|---|---|---|
| 2099369 | 12/1982 | United Kingdom | 346/3 TR |

*Primary Examiner*—E. H. Eickholt

*Attorney, Agent, or Firm*—Kerkam, Stowell, Kondracki & Clarke

[57] ABSTRACT

The invention relates to a printing apparatus of the type which transfers an image without impact. This apparatus includes a flexible recording tape (20), a printing block (28) which is displaced along the tape so as to record latent images onto it and deposit a powdered developer onto these images, the developer thus forming these images in powder. A press cylinder (53) enables the tape (20) to be pressed onto a print carrier (11), which assures the transfer of the powder images onto this carrier. The invention is applicable to the printing of data in a data processing system.

21 Claims, 11 Drawing Figures

NON-IMPACT PRINTING APPARATUS

FIELD OF THE INVENTION

The present invention relates to a non-impact printing apparatus. The apparatus includes a flexible tape provided with a recording surface capable of being magnetized or electrically charged.

BACKGROUND OF THE INVENTION

High-speed printers are already known which upon receiving signals from a control unit print characters on a strip or sheet of paper, using the technique known as non-impact printing. Some of these machines include a flexible recording element comprising an endless ribbon or belt, on the surface of which sensitized zones, also known as latent images and corresponding to the characters or images that are to be printed, can be formed electrostatically or magnetically. These latent images are then developed, or in other words made visible, using a developer, which is typically in the form of a powdered product and is deposited onto the recording element. The developer remains applied only to the sensitized zones on this element so as to form an image in powder. After that, the recording element is put into contact with a print carrier, such as a sheet of paper, so that the particles of developer located on the sensitized zones can be transferred onto this print carrier, where it can be fixed definitively.

Printers of this type are described and shown in various patents, in particular in U.S. Pat. Nos. 3,076,393, 3,142,940, 3,161,544 and 3,254,626 and in French Patents No. 1 513 779 (corresponding to U.S. Pat. No. 3,495,268) and No. 2 209 322 (corresponding to U.S. Pat. No. 3,735,416). The flexible recording element with which these machines are equipped is mounted on rollers or pulleys which drive it along a closed path, along which it travels in succession past a device for recording the latent images, an applicator device which deposits particles of developer onto these latent images, a transfer device which effects the transfer of these developer particles onto a print carrier and finally an erasing device which assures the erasure of the images which have traveled past the transfer device.

Printers of this type can be classified essentially in two different categories. In a first category, including the printers described in the above-named U.S. Pat. Nos. 3,161,544 and 3,142,840, the print carrier, comprising a long strip of paper, remains continuously pressed against the flexible recording element. Given that in these machines of the first category this flexible recording element and this strip of paper are driven such that they are displaced simultaneously and continuously, at quite a high speed, that is, at least several tens of centimeters per second, then when they receive data that is to be printed and is sent to them virtually continuously by a control unit, these machines are capable of printing long strips of paper at a high printing rate, which in fact typically is in excess of 3000 lines of characters per minute. Nevertheless, it is not conceivable for these printers to be used for printing data that are sent intermittently by a control unit, because the strip of paper is driven uninterruptedly at the same rate as the flexible recording element, and so the quantity of paper traveling beneath the transfer device will be out of proportion to what is actually necessary to do this printing. Accordingly, in order to keep the quantity of paper needed for printing data sent intermittently by a control unit down to a reasonable amount, a second category of printers has been designed, which are described for example in the above-named U.S. Pat. No. 3,076,393 and in the above-named French Patents No. 1 513 779 and No. 2 209 322, in which the print carrier, which during its displacement traverses a transfer device in which it is located near the flexible recording element, is normally kept from being in contact with this element and is applied momentarily to it only when the portion of this element that is coated with developer particles intended for transfer onto the print carrier has arrived inside the transfer device. The momentary contact of the print carrier and the flexible recording elements is effected via a pressure plate, which under the control of a cam or electromagnet mechanism presses the print carrier against the recording element for a brief instant. The recording element rests on a plate or support element attached solidly to the printer. To assure that the developer particles that have been deposited on the flexible recording element will be transferred in their entirety onto the print carrier, and that this transfer will be made with all the care needed for obtaining high-quality printing, it is absolutely necessary not only for this carrier and this element to be completely immobilized at the moment when they are put into contact with each other, but also for the pressure plate to be mounted such that it will not vibrate at the moment when it assures the placement of the print carrier in contact with the recording element. To accomplish this result, these printers of the second category must therefore be provided, first, with clutch and brake devices of sufficient capacity that they can communicate rapid accelerations and decelerations to the recording element and, second, with damping devices capable of very rapidly damping the vibrations generated by the repeated impacts of the pressure plate against the support plate. Furthermore, these printers require that the register marks be recorded on the recording element. When the marks pass close by a detection device, the marks are read to cause the braking and then the immobilization of the recording element at the precise moment when the data that are to be printed and are recorded on them arrive at the level of the transfer device. In addition, in the case where the flexible recording element is fabricated from a very thin metal tape, which after being flexed has its two ends joined and then soldered in order to produce an endless tape, it is absolutely necessary to provide this machine with a detection device which causes the recording of data onto the tape to be stopped during the entire time while this soldered zone travels past the recording device. Experience teaches that in this soldered zone, it is virtually impossible to form latent images for characters in which the contours are perfectly well defined. As a result, in the final analysis these printers print the data at a lower speed than the printers in the first category and prove to be complicated and expensive.

Although it has been possible to meet most of the above requirements, still there has been no success in eliminating the vibrations which arise in the flexible recording element either because of the repeated impacts of the pressure plate against the support plate or because of the shock-like displacement of this recording element. Under these conditions it is very difficult to obtain high-quality printing. In addition, the recording element in these machines, which is driven intermittently, is subjected to considerable friction, during the forceful accelerations and decelerations, caused by the pulleys or rollers on which it is mounted. There is very rapid wear as a result, which during normal machine operation requires the operator to replace this recording element quite often, in fact virtually every other day.

OBJECT AND SUMMARY OF THE INVENTION

The present invention proposes a non-impact printing apparatus which prints data at a rate near that of the printing machines of the second category mentioned above, yet overcomes its disadvantages. Not only is the flexible recording element with which this printer is equipped not subjected during its operation to vibrations likely to impair good printing quality, but its particular disposition, which is inside the apparatus, protects it from premature wear, so that it can be used for a very long time.

More specifically, the present application relates to a non-impact printing apparatus including at least one flexible recording carrier provided with a surface for recording latent images, at least one recording device cooperating with this recording carrier to form a latent image on this surface, at least one applicator device arranged for depositing particles of developer onto this surface, these particles remaining applied only on this latent image in order to form an image in powder, and at least one transfer device for transferring this image in powder onto a print carrier. This printing apparatus is characterized in that the flexible recording carrier has at least one end that is fixed with respect to the surface of a stationary support element on which the print carrier is positioned, and this recording carrier is held taut at least between the recording device and this end of the recording carrier, and in that, given that the recording device, the applicator and the transfer device are displaced along this recording carrier in order to form an image in powder upon it and transfer this image onto the print carrier, this transfer device comprises a presser element which in the course of its displacement assures that this recording carrier and this print carrier are put in contact with each other.

The invention will be better understood and further objects, details and advantages thereof will become apparent from the ensuing description given by way of non-limiting example, taken in conjunction with the drawings.

DESCRIPTION OF THE PREFERRED EMBODIMENTS

Figure 1:
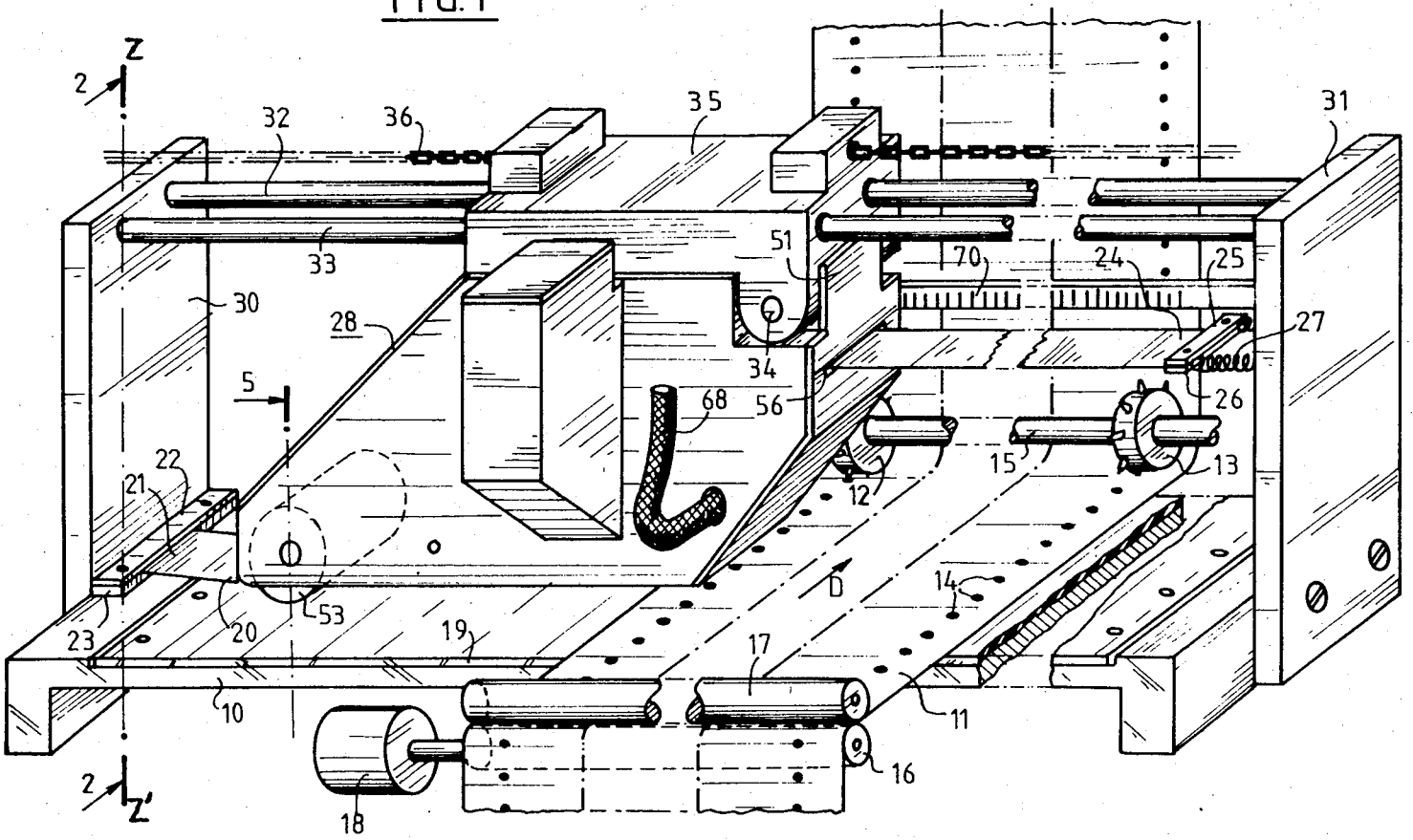
FIG. 1 is an overall view in perspective of a printing apparatus in accordance with the invention.
Figure 5:
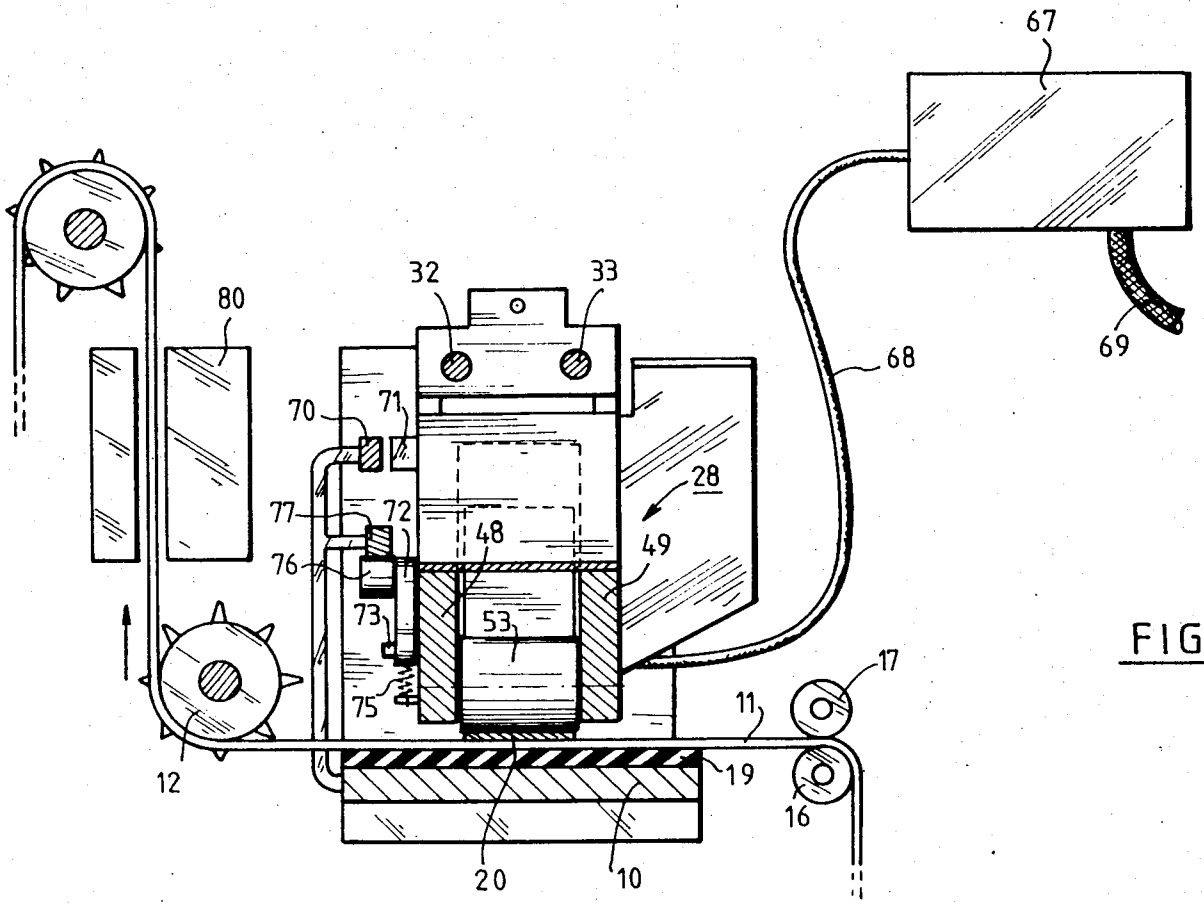
FIG. 5 is a side view of the printing apparatus shown in FIG. 1, in a fragmentary section taken along a direction indicated by the arrow 5 in FIG. 1.

The printing apparatus shown in FIG. 1 is of the non-impact printer type, and it includes a support plate 10 arranged horizontally, which serves to support a strip of paper 11 that is to be imprinted. This strip of paper 11 is displaced intermittently by a drive mechanism of a known type, for example two sprocket wheels 12 and 13, the pins of which engage perforations 14 provided at regular intervals along the two lateral edges of the strip 11. These two wheels 12 and 13 are attached to the same drive shaft 15, which is set into rotation by an electric motor (not shown). Let it be assumed that the direction of displacement of the strip of paper 11 is as indicated by the arrow D in FIG. 1. In order to be kept held against the support plate 10 during its passage, the strip of paper 11 is engaged between two friction rollers 16 and 17, one of which, 16, is coupled to a permanent brake 18 and the other of which, 17, is urged to press toward the roller 16 by springs of a known type, which are not shown in FIG. 1 for obvious reasons of simplification. Thus as FIGS. 1 and 5 show, the sprocket wheels 12 and 13 and the rollers 16 and 17 are positioned such that the portion of the strip of paper 11 that is included between these wheels and these rollers is in contact with a thin plate 19, which is fixed on the support plate 10 and comprises an elastic material, such as natural rubber, for example, or the flexible synthetic material generally known as an elastomer. The role of the plate 19 is, by its elasticity, to assure high-quality contact between the strip of paper 11 and a flexible recording carrier 20 which is temporarily presed onto this strip in a manner to be described later herein.

FIG. 1 also shows that the support plate 10 is rectangular in shape and is disposed in such a way that its length is perpendicular to the direction D of displacement of the strip of paper 11. Along its short sides, this support plate 10 is provided with two upright members 30 and 31, serving to support two horizontal guide rods 32 and 33 to be described in further detail later herein. These rods 32 and 33 are placed between the upright members 30 and 31 and are disposed parallel to the length of the support plate 10.

The flexible recording carrier 20 with which the printing apparatus shown in FIG. 1 is equipped is intended, in the example described, to enable the magnetic formation of latent images which correspond in shape to that of the characters to be printed. In the exemplary embodiment shown in FIG. 1, this recording carrier is in the form of a flexible metal tape comprising a high-coercivity magnetic material. Thus, in this exemplary embodiment, this tape is made from an iron-cobalt-vanadium alloy, sold under the name "AFK 584" (registered trademark) by the Societe Metalimphy. This tape has a virtually rectangular hysteresis cycle and has a coercive field $H_c$ on the order of 380 oersteds (hence approximately 30,240 ampere turns per meter).

Additionally, this tape has a thickness in the range between 10 and 80 μm, such that it proves to be particularly flexible yet still retains great resistance to wear while in use. It should be noted, however, that the type of material of which this tape is made is not exclusive to the present invention. Any other type of flexible material which can be magnetized and then demagnetized can be used to make this tape. For instance, rubber in which magnetic particles are incorporated, or a flexible plastic material of the type known by the name "KAPTON" (registered trademark) may be used. When the tape is made of this plastic material, it is coated on one of its surfaces with a layer of magnetic oxide. It should also be noted that the recording carrier 20 can be realized not only in a flexible material capable of being magnetized and then demagnetized, but also in a flexible dielectric material on which electric charges can be formed; this dielectric material may for instance comprise a plastic material of the type sold commercially under the name of "nylon" (registered trademark).

In all cases, the recording carrier 20, which as mentioned above comprises a material enabling the formation of latent images either magnetically or electrostatically depending on the nature of this material, takes the form of a flexible tape, band or ribbon, provided with two ends 21 and 24, one of which, 21, is engaged between two retaining bars 22 and 23 which are pressed together and attached by screws to the support plate 10, along the upright member 30. These two retaining bars 22 and 23 comprise an attachment element which allows the end 21 of the recording tape 20 to remain fixed in immediate proximity to the support plate 10. In the embodiment shown in FIG. 1, the recording tape 20 traverses a printing block 28 which will be described in further detail later herein, and at its other end 24 is engaged between two retaining bars 25 and 26 which are pressed together by screws. The unit thus comprising these two bars 25 and 26 is kept attached to the upright member 31 and at a level higher than that of the bars 22 and 23 by a tensioning device, which in the example shown in FIG. 1 comprises springs 27 and enables the recording tape 20 to be kept slightly under tension above the strip of paper 11, transversely with respect thereto.

Figure 2:
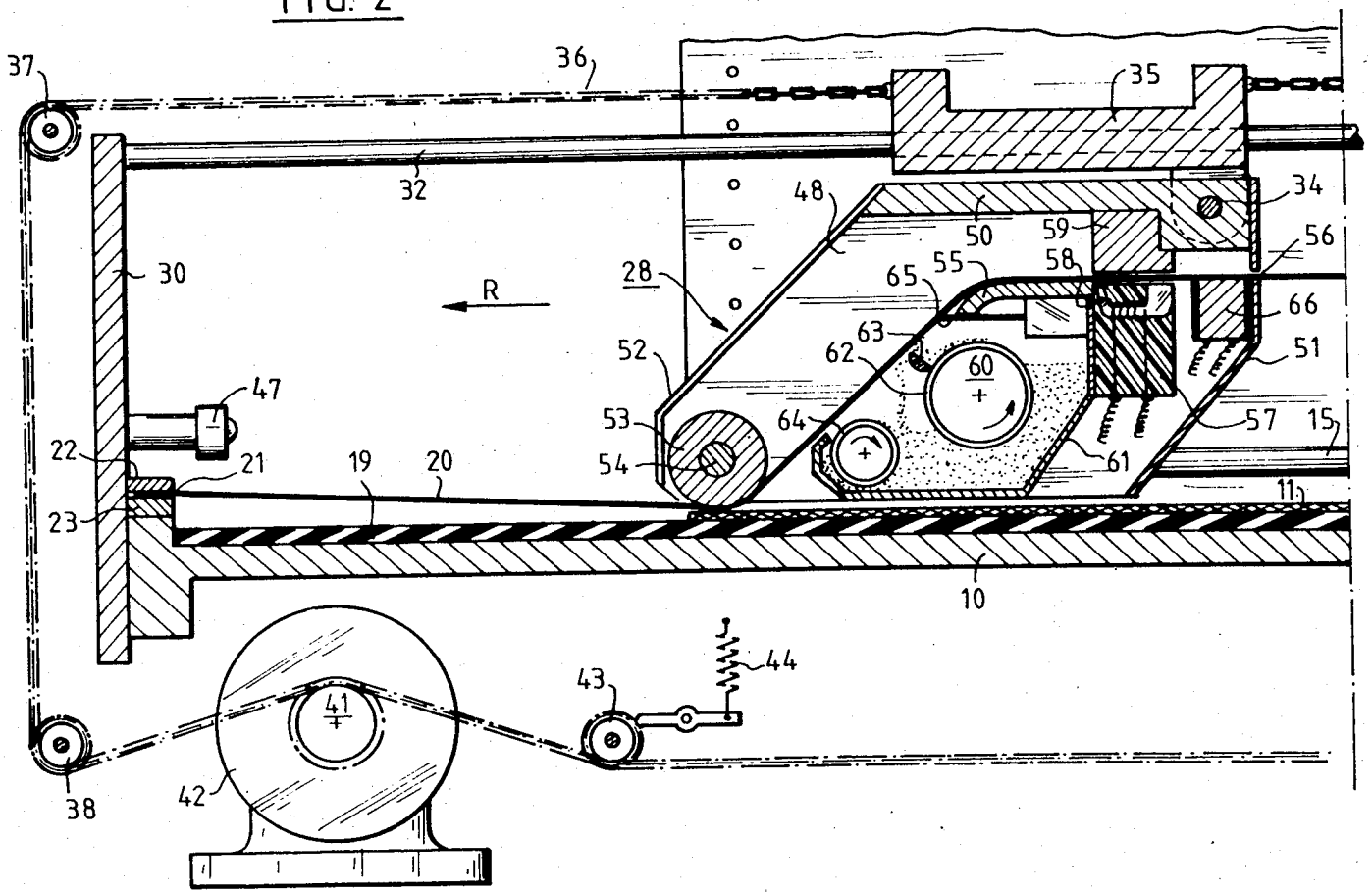
FIG. 2 is a schematic view of the printing apparatus shown in FIG. 1, in the direction indicated by the arrows 2—2, of a vertical section taken along a longitudinal plane extending along the line Z—Z' in FIG. 1.
Figure 3:
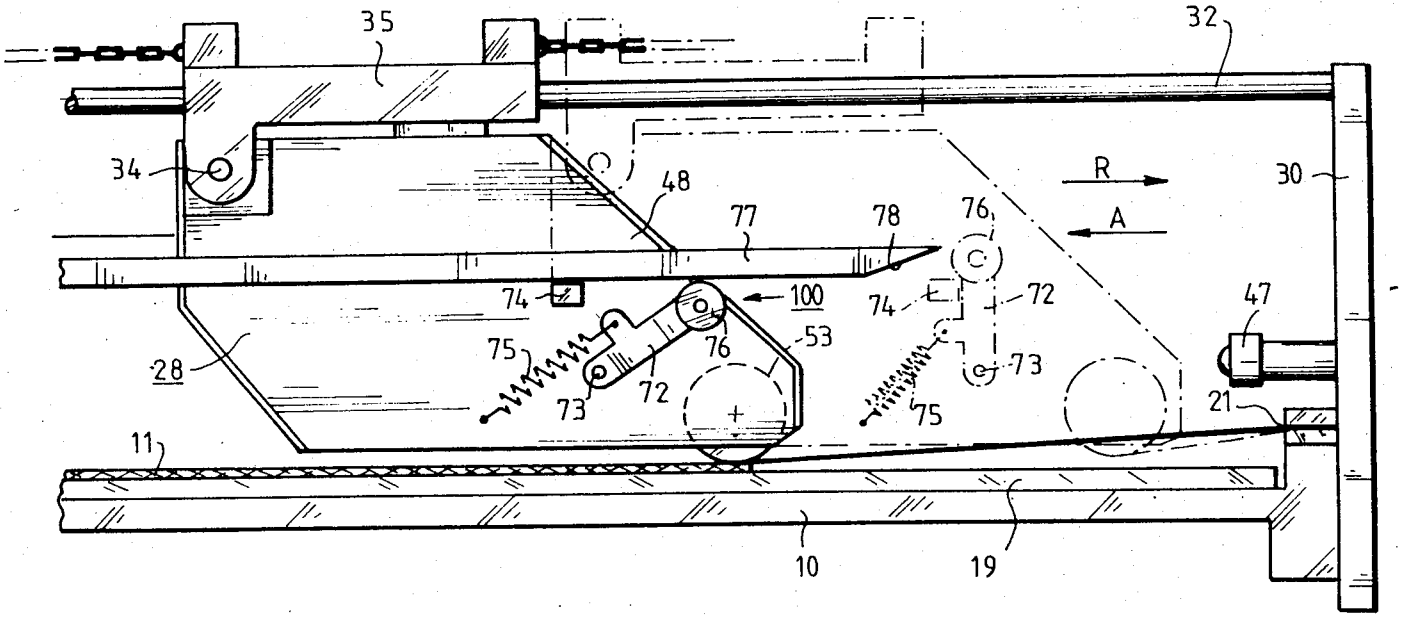
FIG. 3 is an elevation showing the back of the printing apparatus shown in FIG. 1, and in particular showing the position assumed by various constituent parts in the course of the forward displacement of the carriage.
Figure 4:
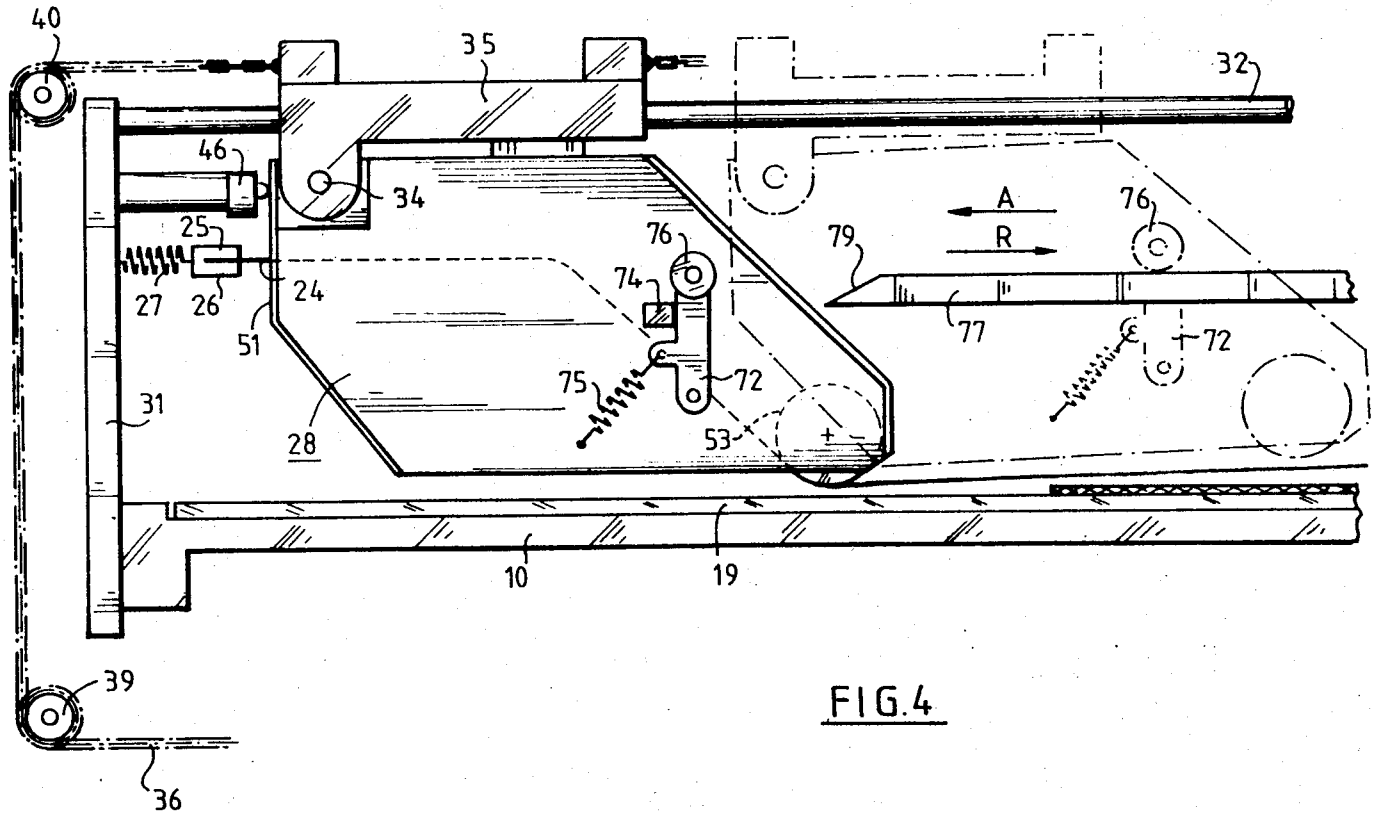
FIG. 4 is an elevation showing the back of the printing apparatus shown in FIG. 1, and in particular showing the position assumed by various constituent parts in the course of the return displacement of the carriage.

FIG. 1 also shows that the printing block 28 is articulated about a horizontal shaft 34 which is fixed to a carriage 35 that is capable of sliding on the guide rods 32 and 33, which extend above the recording tape 20 and thus enable the displacement of the printing block 28 along this tape. The carriage 35 is attached to a drive chain 36 which, as shown in FIGS. 2 and 4, travels over return pulleys 37, 38, 39 and 40, as well as over a toothed drive wheel 41 connected to the shaft of an electric motor 42 (see FIG. 2). The tension of the drive chain 36 is assured by a tensioning roller 43 stressed by a spring 44 in the manner shown in FIG. 2. Under these conditions, upon suitable excitation of the electric motor 42, the displacement of the carriage 35 and printing block 28 can be brought about, in the direction of either the upright member 30 or the upright member 31. This displacement is limited by two stops comprising electrical contacts 46 and 47 (see FIGS. 2 and 4). When the unit comprising the carriage 35 and the printing block 28 is driven in the direction of the upright member 31, that is, in the direction indicated by the arrow A in FIG. 4, the stoppage of the movement is brought about by the electrical contact 46, which being joined to the upright member 31 is disposed on the path taken by the printing block 28, and is actuated by this block at the instant it arrives in proximity with the upright member 31. In like manner, when the unit comprising the carriage 35 and the printing block 28 is driven in the direction of the upright member 30, that is, in the direction indicated by the arrow R in FIGS. 2 and 3, then the stoppage of the movement is effected by the electrical contact 47, which is joined to the upright member 30 and so is disposed on the path of the printing block 28, and is actuated by this block at the instant the block arrives in proximity with the upright member 30.

Thus, as FIGS. 2 and 5 show, the printing block 28 comprises, first, two lateral flanges 48 and 49 disposed vertically, parallel to the length of the support plate 10. The flanges are fixed in their upper portion on a massive horizontal piece 50 disposed between the flanges 48 and 49, and, second, by a plate 51 facing the upright member 31 and a plate 52 facing the upright member 30. All these elements are assembled together such that they form a box. The massive piece 50 is pivoted in its portion near the plate 51, by the articulation shaft 34 mentioned above. Under these conditions, the weight of the box urges it to pivot about the shaft 34, until its center of gravity, located at a lower level than and to the left of the shaft 34 as seen in the drawing in FIG. 2, comes to be located below this shaft. This box is meanwhile retained by a press cylinder 53, which is disposed inside the box and is mounted freely on a shaft 54 that is fixed between the lateral flanges 48 and 49, near the bottom edge of these flanges and of the plate 52, and comes to rest on the recording tape 20. It should be noted to this end that, as can be understood from FIGS. 1 and 2, the recording tape 20 the end 21 of which is fixed in proximity with the surface of the support plate 10, passes underneath the press cylinder 53, and then over a fixed guide plate 55 housed in the interior of the box, and returns to the printing block 28 via an opening 56 made in the plate 51. This guide plate 55 and this opening 56 are located virtually at the same level as the bars 25 and 26 and the springs 27 which exert traction on the end 24 of this recording tape. The springs 27 are selected such that the tension exerted on the recording tape 20 will be as little as possible, yet still adequate to assure that this tape will always have three substantially flat portions while the apparatus is in operation, that is, the portions of the tape 20 that are respectively included between the end 21 and the press cylinder 53, between the press cylinder 53 and the guide plate 55, and between the guide plate 55 and the end 24 of the tape. As will become apparent below, good printing quality cannot be obtained unless the recording tape 20 is properly taut.

To enable the formation on the recording tape 20 of the latent images required for printing the strip of paper 11, the printing apparatus shown in FIG. 1 is provided with a latent image recording device 57, which as shown in FIG. 2 is housed in the interior of the box comprising the printing block 28. In the example described, where the recording tape 20 is made of a material that is capable of being magnetized, this recording device 57 comprises a module including a plurality of magnetic recording heads, one of which, 58, is visible in FIG. 2. These heads will not be described in detail herein because their construction is of a known type. It will simply be noted that in thee exemplary embodiment shown in FIG. 2, these heads are of the type described as an accessory in U.S. Pat. No. 2,840,440. Each of these heads includes a metal core in the form of a U, on which a winding has been wound. This core has a recording pole at one end, and a pole for closing the magnetic flux at its other end. These two poles are disposed in immediate proximity to, in fact in contact with, one of the surfaces of the recording tape 20. A magnetic shunt 59, located near the other surface of this tape and vertically with respect to the poles of each head, assures the closure of the magnetic flux generated by this head when an electric current passes through its winding. When the printing block 28 is driven for displacement along the recording tape 20, the instants of excitation of the magnetic heads are set, in a known manner, such that virtually punctiform magnetized zones are obtained on the surface of this tape 20, the totality of these magnetized zones comprising the latent magnetic images the shape of which corresponds to that of the characters that are to be printed.

As shown in FIG. 2, the printing apparatus also includes an applicator device 60, which is housed in the interior of the box comprising the printing block 28 and enables particles of powdered developer contained in a reservoir 61 disposed below the recording tape 20 to be applied onto this tape. In the exemplary embodiment shown in FIG. 2, this applicator device 60 includes, in a manner known in the prior art, first, a rotating magnetic cylinder 62, which picks up particles of developer located in the reservoir 61 so as to place them near the lower surface of the tape 20, and second, a fixed deflector 63 which is located betweeen the magnetic cyclinder 62 and the recording tape 20 in order to collect the particles transported by this cylinder 62 and to apply them to the lower surface of this tape. The particles of developer thus applied to the tape 20 do not, in principle, adhere to any but the magnetized zones which have been formed on this tape. Nevertheless, in order to eliminate the developer particles which have adhered elsewhere than to the magnetized zones on the tape, as well as those present to excess on these zones, the printing block 28 is also provided with a retouching device 64. Device 64 is disposed in proximity with the tape 20 and collects the particles of developer which are present in excess so as to return them to the reservoir 61. The transfer of the particles of developer now remaining on the recording tape 20 onto the strip of paper 11 is assured by the press cylinder 53, which as will be explained below presses this tape 20 against the strip of paper 11. The residual particles of developer which are still located on the recording tape 20 once this transfer has been accomplished are then lifted off by a cleaning device, which in the example being described comprises a scraper 65, which is disposed above the reservoir 61 and is permanently pressed against the surface of the tape 20. Finally, an erasing device 66, of a known type, is mounted in the interior of the box, between the plate 51 and the recording device 57, and is in contact with the recording tape. The erasing device 66, when it is excited by an alternating electric current, effects the demagnetization of the portions of this tape which travel past it.

As shown in FIG. 5, the strip of paper 11 passes underneath the recording tape 20 and has been coated with the developer particles that have been transferred from tape 20 onto this strip of paper 11. Paper strip 11 then traverses a fixing station or oven 80, in which a heating element causes the resin comprising these particles to fuse. This assures the permanent fixation of the developer on the strip of paper.

The pulses of electric current required for selectively exciting the magnetic recording heads which are part of the recording device 57 are produced by source of control signals 67, which as FIG. 5 shows is connected to the printing block 28 via a flexible cable 68. It is understood that this signal source 67 is in turn connected via a flexible cable 69 to a central unit which will be described in greater detail below. It should be noted that the signal source 67 sends pulses of current to the magnetic heads only when they in turn receive electrical signals emitted in the form of electric pulses by a synchronization signal generator. In the example described, and as shown in FIGS. 1 and 5, this generator comprises, first, an encoder board 70, which is held by upright members attached to the support block 10 and is disposed parallel to the guide rods 32 and 33, near the printing block 28, and is provided with regularly spaced lines or slits on its portion located vertically with respect to the strip of paper 11, and, second, a detector 71 of a known type, which is fixed on the printing block 28 vertically with respect to the board 70 and generates an electric pulse each time it travels past one of the lines (or slits) of this board 70 in the course of the displacement of the printing block.

In the initial state, the printing block 28 is in a position of rest, in which the plate 52 of this block is pressed against the electrical contact 47 and thus keeps this contact pressed in. In FIG. 3, broken lines indicate the position the printing block 28 assumes when, being displaced in the direction indicated by the arrow A, it has left its position of rest, but is still near this position of rest. Thus it will be understood that as long as the printing block is located in its position of rest or near this position of rest, the end of the block which bears the press cylinder 53 remains raised, this raised state being due to the fact that the springs 27 are exerting enough tension on the recording tape 20 to keep it out of contact with the thin plate 19 covering the support plate 10. This forces the press cylinder 53, which is resting on this tape, to remain a slight distance away from the surface of this plate 19. To enable the press cylinder 53 to cause the recording tape 20 to be applied first to the plate 19 and then to the strip of paper 11 which is located on this plate 19, the printing apparatus is provided with an actuating mechanism 100, which as shown in FIG. 3 includes a lever 72, one end of which is articulated about a shaft 73 that is fixed on the lateral flange 48. As long as the printing block 28 is located in its position of rest or near it, this lever 72 normally remains held in a vertical position, being pressed by a traction spring 75 against a stop 74 that is fixed on the flange 48 above the shaft 73.

On its upper end, the lever 72 has a roller 76, which when the printing block 28 is driven in the direction indicated by the arrow A, beginning at its position of rest ends up in contact with a fixed horizontal rail 77 disposed on its path. This rail 77, which is part of the actuating mechanism 100, extends above the support plate, parallel to the guide rods 32 and 33, as shown in FIGS. 3 and 5. Beginning at this moment, because of the displacement of the printing block in the direction of the arrow A, the roller 76, comining to a stop against the end of the rail 77, compels the lever 72 to move away from the stop 74, which stretches the spring 75 further and lowers the roller 76. Under these conditions, in the course of the displacement of the printing block 28 beginning at its position of rest, the roller 76 comes to roll over an inclined ramp 78 provided at the right-hand end of the rail 77 (as seen in FIG. 3) and extending from top to bottom and then over the lower edge of this rail. Meanwhile, the lever 72, subjected to the action of the spring 75, tends to resume its initial vertial position and thus urges the end of the printing block which has the press cylinder 53 downward. As a result, the cylinder 53, which is thus urged downward, then comes to be pressed against the recording tape 20, first on the surface of the elastic plate 19 and then on the strip of paper 11 which is positioned on this plate. This pressure continues until the instant when the roller 76, having arrived at the left-hand end of the rail 77 (see FIG. 4), is freed and allows the lever 72 to return, under the influence of the spring 75, to its vertical position against the stop 74. At this moment, the press cylinder 53 ceases to press the recording tape 20 onto the elastic plate 19. The movement of the printing block 28 along the direction of the arrow A continues meanwhile, until the plate 51 of this block coms to press the electrical contact 46 in. As will be seen later, the effect of pressing in the contact 46 is that the movement of the printing block 28 is reversed. The block is arrested for a brief instant, then it is displaced in the opposite direction, that is, in the direction indicated in FIG. 4 by the arrow R. In the course of this movement, the roller 76 comes to be in contact with an inclined ramp 79, which leads from bottom to top and is formed at the left-hand end of the rail 77. However, given that the lever 72 is kept held by the stop 74 and thus can no longer be inclined, the roller 76 is constrained to roll, in the course of the displacement of the printing block 28, to roll first over the inclined ramp 79 and then over the upper edge of the rail 77, such that the end of this block which supports the press cylinder 53 is compelled to be raised. Which enables the recording tape 20 to be kept out of contact with the strip of paper 11. The strip of paper 11 can then be displaced by operation of the sprocket wheels 12 and 13. When the roller 76 rols over the upper edge of the rail 77, the distance which separates the press cylinder 53 from the elastic plate 19 is slightly greater than that separating this same cylinder from this plate when the printing block 28 is located in or near a position of rest. Under these conditions, when the roller 76 arrives at the right-hand end of the rail 77 (see FIG. 3), the end of the printing block which supports the press cylinder 53 drops slightly and assumes the position shown in broken lines in FIG. 3. The movement of the printing block in the direction of the arrow R continues, until the contact 47 is once again pressed in by the plate 52.

In the example described, the actuating mechanism 100 which enables the press cylinder 53 to press the recording tape 20 onto the plate 19 and the strip of paper 11 solely when the carriage 35 is driven in the direction of the arrow A is a purely mechanical device, comprising the lever 72, the shaft 73, the stop 74, the traction spring 75, the roller 76 and the rail 77, all these elements being disposed in such a manner, as shown in FIGS. 3, 4 and 5, that they function under the conditions described in detail above. It should be understood, however, that the mode of realization of this actuating mechanism is not exclusive to the invention and that any other equivalent actuating mechanism, such as an electromechanical actuating mechanism, for example, can be used to control the movment of the press cylinder 53.

Figure 9A:
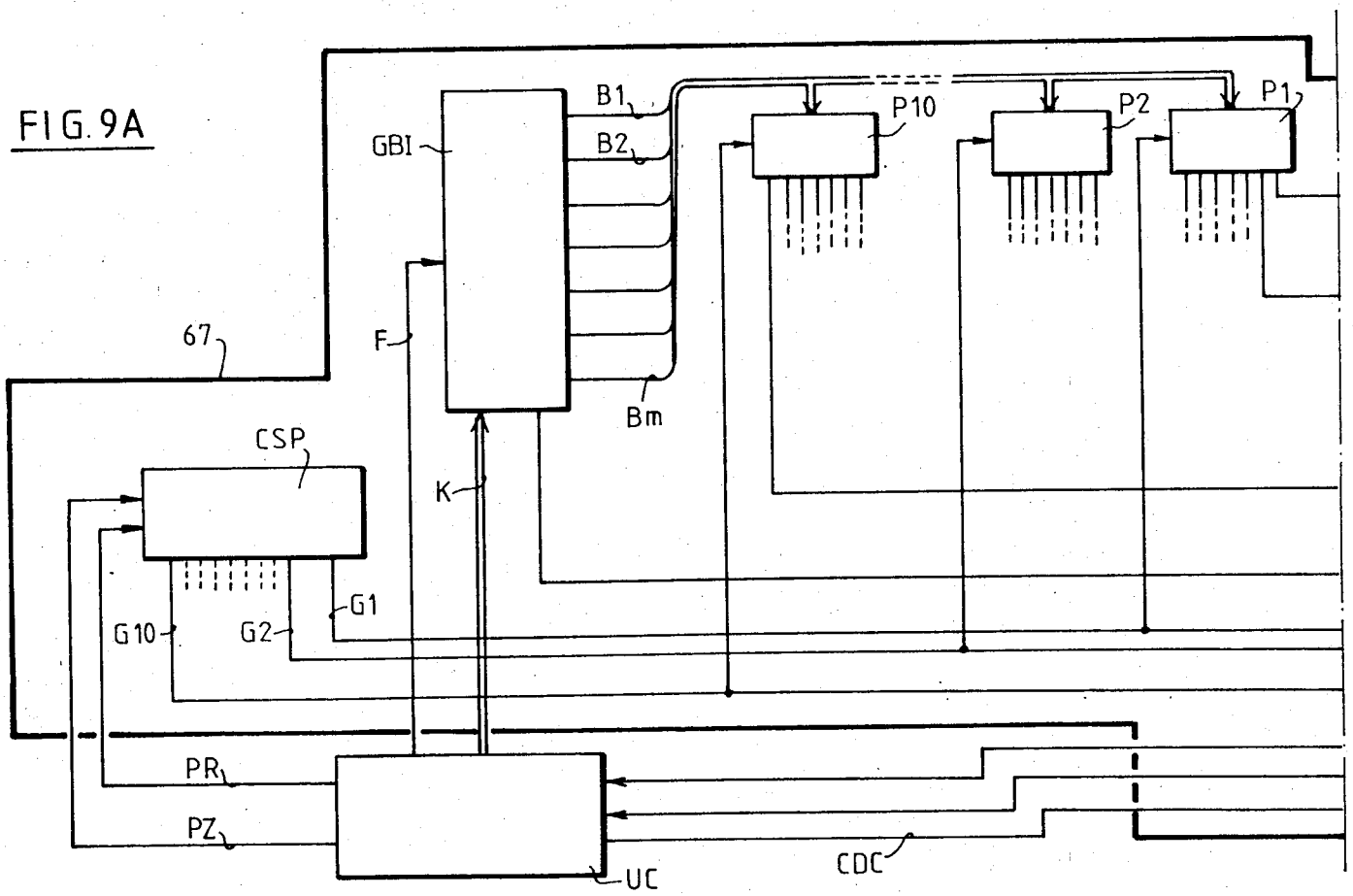
FIGS. 9A, 9B and 9C, when they are assembled, show a detailed diagram of the circuits used to control the functioning of the printing apparatus shown in FIG. 1.
Figure 9B:
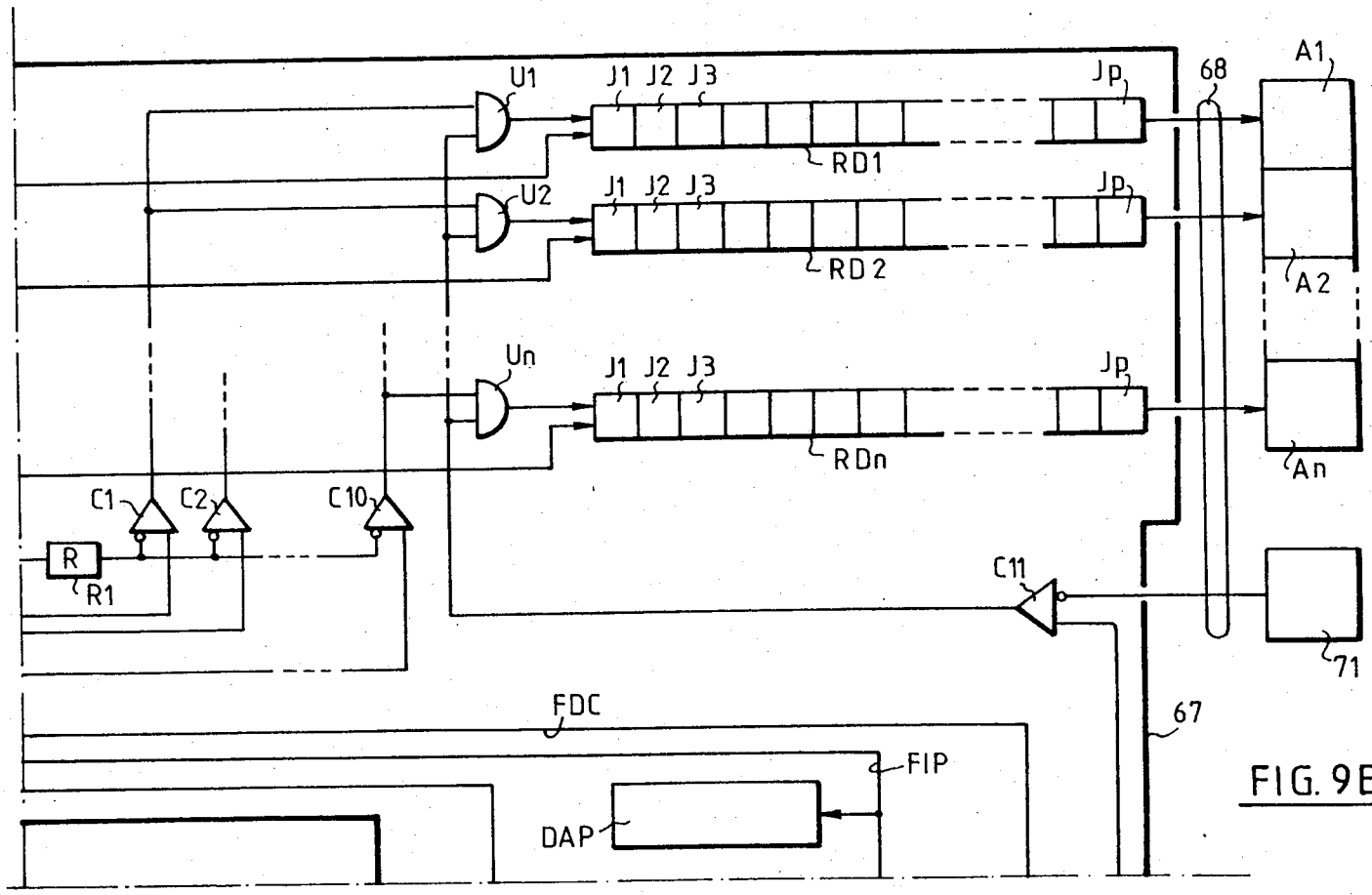
Figure 9C:
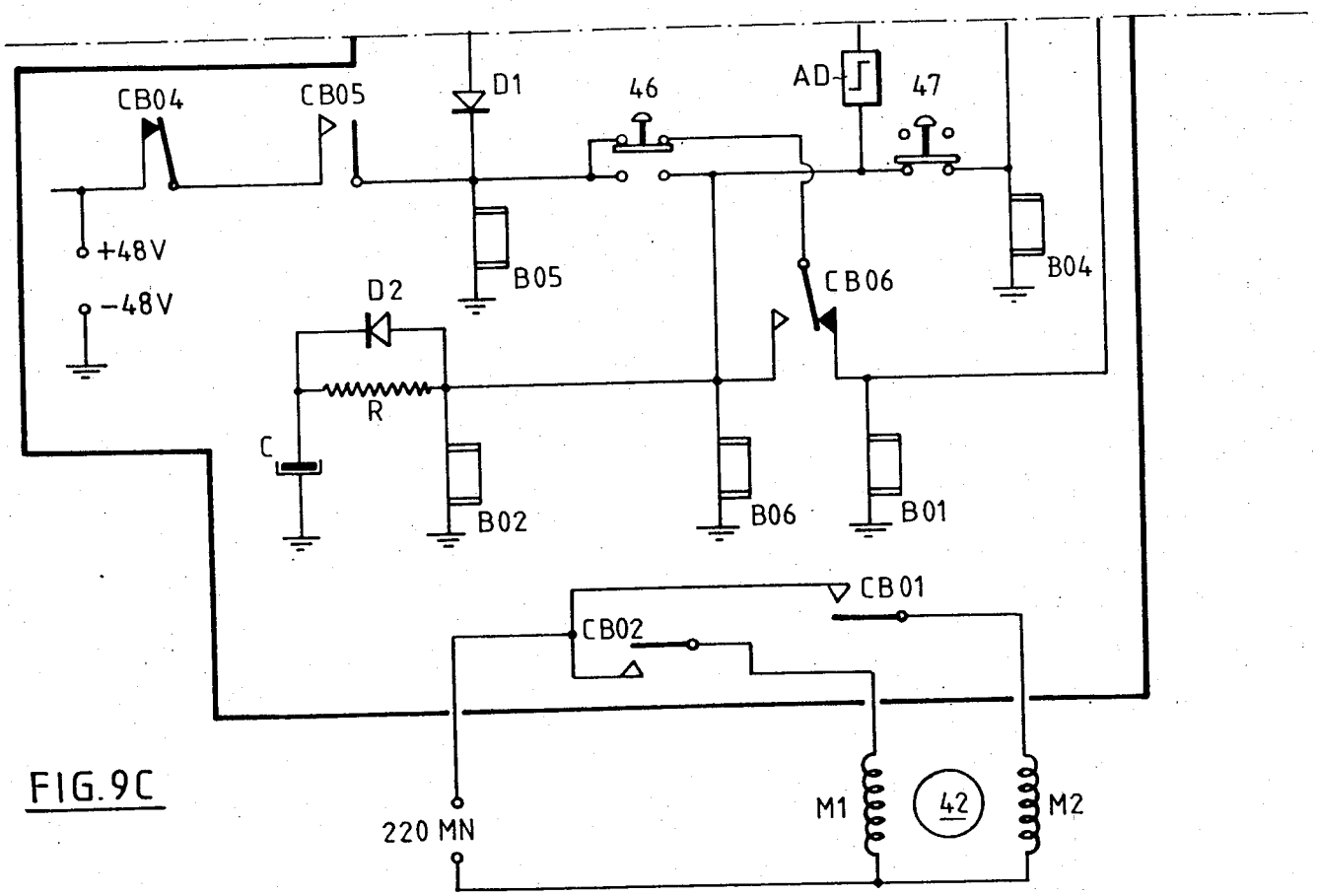

FIGS. 9A, 9B and 9C, when they are put together, represent a skeleton diagram of the control circuits used to control the printing apparatus that has been described above. These circuits include, first, logic circuits shown in FIGS. 9A and 9BV and, second, electrical circuits which are shown in FIGS. 9C and which are connected to these logic circuits and are intended more particularly for controlling the electric excitation of the motor 42. The electric diagram of FIG. 9C is also a skeleton diagram which in the embodiment shown in this figure includes manual control and relay contacts provided so that they can be used under the above-described conditions. In FIG. 9C, each relay contact is assigned the same reference symbol as the coil which controls it, but preceded by the letter C. A contact which is normally closed when the relay coil controlling it is not excited is represented by a solid black triangle. The relays shown in FIG. 9C are normally supplied with direct current picked up between two terminals +48 V and −48 V.

Since the terminal −48 V is connected to ground, the electric circuits shown in FIG. 9C include a relay coil BO5, one of the terminals of which is connected to ground and the other terminal of which is connected to the +48 V terminal via two relay contacts CBO4 and CBO5 connected in series. Contact CBO4 is narmally closed, while the contact CBO5 is normally open. The other terminal of the coil BO5 is connected with the movable contact spring of a change-over contact CBO6 via the contact 46 when it is in the non-pressed-in position, and is connected with the normally open contact of this change-over contact via the contact 46 when it is in the pressed-in position. Two relay coils BO2 and BO6 are connected in parallel between this same normally open contact and ground. A capacitor C, one of the terminals of which is connected to ground, is connected via its other terminal and via a resistor R to this same normally open contact, while a diode D2, connected in parallel to the terminals of this resistor R, enables the rapid charging of this capacitor C when the contacts CBO4 and CBO5 are closed and the contact 46 is in the pressed-in condition. The electric circuits shown in FIG. 9C also include a relay coil BO4, one terminal of which is connected to ground and the other terminal of which is connected to the normally open contact of the change-over contact CBO6 via the contact 47 when that contact is in the pressed-in condition. These electric circuits also include a relay coil BO1, one terminal of which is connected to ground and the other terminal of which is connected to the normally closed contact of the change-over contact CBO6.

The electric motor 42 which drives the carriage 35 and the printing block 28 is a motor in which the direction of rotation is reversed in a known manner, depending on the type of motor used. It will be assumed that in the exampled described herein and shown in FIG. 9C, this motor is of the alternating current type and includes two exciting windings M1 and M2 wound in opposition, such that when one of the windings is excited the motor 42 turns in one direction and when the other winding is excited the motor turns in the opposite direction. The two windings M1 and M2 can be suplied with monophase 220-volt alternating current furnished by two terminals 220 MN, via two switch contacts CBO1 and CBO2 controlled by the two relay coils BO1 and BO2, respectively.

The logic circuits shown in FIGS. 9A and 9B include a group of n shift registers, designated as RD1, RD2, .

. . , RDn, each of them associated with a respective one of n magnetic recording heads of the recording device 57. Each of these registers includes p storage positions J1, J2, . . . , Jp arranged so that each contains one binary number, known as a data bit, which in a manner to be explained below is capable of causing the excitation of the winding of the recording head associated with this register. This excitation, as has been explained above, brings about the formation of a virtually punctiform magnetized zone, known as a magnetized point, on the surface of the recording tape 20. To this end, these shift registers are each provided with one output, and each of these outputs is connected respectively to each of the n windings A1, A2, . . . , An of the n magnetic recording heads. Thus each time a binary number 1 is extracted from a shift register, this binary number is delivered in the form of an electrical pulse to the winding associated with this register. This causes the appearance of a magnetized point on the recording tape 20.

It should be noted at this point that in the example described, the recording device with which the apparatus shown in FIG. 1 is equipped is intended for recording and then printing ten lines of characters simultaneously; these lines are perpendicular to the direction D in which the strip of paper 11 is displaced, and each of these characters comprises a set of points located inside a matrix comprising m lines of points and q columns, each character being spaced apart from the ones adjacent to it by a space of j columns. Thus, given that each character extends over q columns, the number p of storage positions in each of these registers RD1, RD2, . . . , RDm is then such that $$p=k(q+j),$$

where k is the maximum number of characters that can be printed on the same line of characters on the strip of paper 11. On the other hand, given that the recording device 57 is intended for recording and then simultaneously printing ten lines of characters, the number n of shift registers RD1, RD2, . . . , RDn is thus such that $$n=10m.$$

Under these conditions, the n shift registers RD1, RD2, . . . , RDn are distributed into ten groups of registers, each group including m shift registers. In the example described, the values of m, q, j and k have been selected to be equal to 7, 5, 3 and 80, respectively. In this case, the control device shown in FIGS. 9A, 9B and 9C includes ten groups of seven shift registers, hence a total of 70 registers; each of these registers includes 640 storage positions and each storage position is capable of containing one binary number, known as a data bit, which is thus either the number 0 or the number 1.

The data bits which are intended for recording in the p positions in the shift registers come from a data bit generator GBI, which is connected via a set of conductors generally identified by the symbol K to the central unit UC of the data processing system of which the printing apparatus is a part. The data bits, as will be seen below, are generated by generator GBI, and are sent by means of a set of m conductors B1, B2, . . . , Bm connected to the outputs of this generator to a set of gates P1, P2, . . . , P10. Each gate is associated with a respective one of each of the ten groups of shift registers. Hence the gate P1 is associated with the first group of registers, and this group includes m shift registers. Thus, in the example described, where m=7, these are the registers RD1, RD2, RD3, RD4, RD5, RD6 and RD7. In like manner, the gate P2 is associated with the second group of shift registers, and so forth. The ten gates P1, P2, . . . , P10 are opened selectively by means of positive electrical voltages, which being delivered selectively via the ten outputs of a selection switch CSP, are applied respectively to each of these gates via one of ten conductors G1, G2, . . . , G10. The selection switch CSP is arranged such that it delivers positive voltage only to a single one of these ten conductors. This selection switch CSP is connected to the central unit UC via two conductors PR and PZ and it is designed in such a way that each time the central unit UC sends an electrical pulse over the conductor PR, the positive voltage that has just then been present on one of the ten conductors G1–G10 disappears, while a positive voltage appears on the next conductor in order, these conductors being arranged in succession from G1 to G10. Thus to take an example, if the conductor that is carrying a positive voltage at the moment when the central unit sends a pulse over the conductor PR is the conductor G1, the effect of this pulse is to cause this positive voltage on the conductor G1 to disappear, while a positive voltage then appears on the next higher numbered conductor G2. The selection switch CSP is also arranged such that each time it receives a pulse sent from the central unit UC via the conductor PZ, it furnishes a positive voltage solely over the conductor G1. This selection switch CSP will not be described in detail, because its structure is known to those skilled in the art. It will be appreciated that in the example described, this switch comprises a scanning train analogous to that which is also described and shown in French Pat. No. 2 442 335. The electrical voltages furnished via the conductors G1–G10 are applied not only to the gates P1–P10 but also to a set of six control circuits C1, C2, . . . , C10, of a known type and analogous to those described and shown particularly in French Pat. Nos. 1 342 787 and 1 387 085. Each of these control circuits has two inputs; one of them, indicated by a point on the drawing figures, is a conditioned input to which electrical pulses that are to be transmitted are applied, and the other input is a conditioning input to which an electrical voltage is applied. Also, each control circuit transmits a pulse applied to its conditioned input only if its conditioning input is connected to a positive potential. FIGS. 9A and 9B show that these conditioned inputs of the control circuits C1, C2, . . . , C10 are connected to the data bit generator GBI via a delay element R1, which will be discussed below, and that the conditioning inputs of these circuits C1, C2, . . . , C10 are each connected to a respective one of the conductors G1, G2, . . . , G10. The output of the control circuits C1 is connected, via m OR circuits U1, U2, . . . , Um, to the inputs of the registers comprising the first group of shift registers. In like manner, the output of the circuit C2 is connected, via another m OR circuits (not shown in these drawings), to the inputs of the registers comprising the second group of shift registers, and so forth.

Given that only one of the conductors G1–G10 is carrying a positive voltage, only one of the control circuits C1–C10 and only one of the gates P1–P10 are simultaneously open. Under these conditions, the data bits, which are sent over the conductors Ba–Bm by the generator GBI and are applied to all the gates P1–P10 simultaneously, but are transmitted by only one of these gates and sent to the group of registers that is associated with that gate. This enables these data bits to be recorded in this selected group of registers.

For the sake of better comprehension of the functioning of the apparatus described above, the operations will now be described in the order in which they occur, which enable data bits furnished by the generator GBI to be recorded in the ten groups of registers. These operations begin with the sending of a pulse, which is furnished by the central unit UC and transmitted via the conductor PZ, to the selection switch CSP. As a result, as noted above, the conductor G1 is provided with a positive potential. Under these conditions, the gate P1 and the control circuit C1 are simultaneously caused to be open. The central unit UC then sends a binary coded combination, representing a character to be printed, to the generator GBI via the conductors K. In response to receiving this coded combination as well as a starting pulse then sent by the central unit UC, via a conductor F, the generator delivers q sets of m binary numbers (in the example described, five sets of seven binary numbers) over the conductors B1, B2, . . . , Bm. It should be noted that the generator GBI is analogous in structure to that also described in French Pat. No. 2 395 148, corresponding to U.S. Pat. No. 4,201,488. Each time one set of m binary numbers is sent by the generator GBI over the conductors B1, B2, . . . , Bm, this set is transmitted only by the gate P1, although it is applied simultaneously to all the gates P1–P10, such that it is recorded in the respective J1 positions of the first group of shift registers, the group which in the example described includes the registers RD1, RD2, . . . , RD7. Furthermore, each time the generator GBI sends a group of m binary numers over the conductors B1, B2, . . . , Bm, it simultaneously sends a pulse to the input of the delay element R1. This pulse, suitably delayed by this element R1, is then applied to the conditioned inputs of the control circuits C1–C10. Meanwhile, among all these circuits, only the circuit C1 is conductive. Consequently this delayed pulse is transmitted only by the circuit C1, and it is applied via m OR circuits U1, U2, . . . , Um to the inputs of the shift registers of the first groups; this causes all the binary numbers recorded in these registers to be shifted one position to the right. As a result, the m binary numbers recorded in the positions J1 of these registers are recorded into positions J2 of these same registers; the m binary numbers recorded in the positions J2 of these registers are recorded into the positions J3 of thes registers; and so on. The delay effected by the delay element R1 is arranged such that when the generator simultaneously sends, first, a group of m binary numbers which are transmitted by the gate P1 and recorded in the positions J1 of these registers and, second, a pulse to the input of the element R1, the delayed pulse which is meant to bring about the shift does not appear at the output of the element R1 until the recording of these m binary numbers into these positions J1 has been completed. In any event, this shift is effected before the generator GBI sends the following group of m binary numbers over the conductors B1, B2, . . . , Bm. The q sets of binary numbers furnished by the generator GBI are recorded in the first group of shift registers in the manner already described. After that, the generator GBI sends j successive pulses to the delay element R1, which causes the binary numbers already recorded in the first group of shift registers to shift by j positions to the right. By their disposition, these binary numbers consitute the image of the first character, and so this shift of j positions makes it possible to provide the necessary space between the image of this first character and the image of the next character in succession.

By definition, it will be appreciated that each time the central unit UC sends over the conductors K a coded binary combination representing a character that is to be printed, and then sends a starting pulse over the conductor F, the generator GBI responds by sending, first, a group of m binary numbers over the conductors B1, B2, . . . , Bm, which are transmitted via the gate P1 and recorded in the first group of registers, and, second, a pulse to the element R1 for effecting the necessary shifting wihtin these registers; these sending operations are repeated q times in succession by the generator GBI, which then, once these q operations have been completed, sends j successive pulses to the element R1 in order to assure the necessary spaces between the character images in the shift registers.

When all the coded combinations, representing characters to be printed in the first line, have been sent by the central unit UC over the conductors K, the central unit then sends a pulse to the selection switch CSP, via the conductor PR. This pulse, as noted above, causes the positive voltage on the conductor G1 to disappear and causes the conductor G2 to be connected to a positive potential. Under these conditions, the gate P2 and the control circuit C2 are simultaneously made conductive. while the gate P1 and the control circuit C1 become non-conductive. The central unit UC then sends the binary coded combinations, representing characters to be printed on the second line, in succession to the generator GBI; the sending of each of these combinations is followed immediately by the sending of a starting pulse to this generator GBI, via the conductor F. In response to receiving these coded combinations, the generator GBI delivers groups of binary numbers, which are applied to the gates P1–P10 but are transmitted only by the gate P2 and then come to be recorded in the second group of shift registers, which in the example described includes the registers RD8, RD9, . . . , RD14.

When the loading of this second group of shift registers has been completed, the central unit UC sends a pulse to the switch CSP, via the conductor PR, which now makes the gate P3 and the control circuit C3 conductive, which enables the loading of the third group of shift registers (that is, in the example described, the registers RD15, RD16, . . . , RD21), analogously to what has been described above. The loading operations for the other groups of shift registers which now ensue are similar to those described in detail above, and so will not be described in further detail now.

When the loading of the ten groups of shift registers has been completed, the central unit UC sends a pulse over a conductor CDC, which pulse, as will now be shown, is intended to trigger the driving of the carriage 35 and of the printing block 28 which is articulated on this carriage. To this end, and as shown in FIGS. 9A, 9B and 9C, this pulse is applied via a diode D1 to the relay coil BO5. The relay BO5, which is thus excited by this pulse for a brief instant, closes its contact CBO5 and establishes a holding circuit for itself, because a continuous current, beginning at +48 volts, now circulates via the contact CBO4, which is normally closed, and the closed contact CBO5. The relay BO5 thus remains excited as long as the contact CBO4 remains closed. Furthermore, because as noted above the printing block 28 initially is in a position of rest, in which the contact 47 is kept pressed in and consequently the contact 46 is not pressed in, a continuous current beginning at +48 volts now circulates, via the closed contacts CBO4 and CBO5, between the contact 46 that is not pressed in and a change-over contact CBO6 which is at rest, and this causes the excitation of the relay BO1. In addition, a control circuit C11, the conditioning input of which is connected in parallel with the relay BO1, as shown by FIGS. 9B and 9C, is made conductive. The relay BO1, being excited, closes its contact CBO1 and then causes monophase alternating current furnished by the terminals 220MN to be supplied to the winding M2. Under these conditions, the motor 42 turns over and drives the carriage 35 and the printing block 28 in the direction indicated by the arrow A in the drawings. As a consequence of this movement, the printing block 28 leaves its position of rest and thus frees the contact 47, which stands out once again. Shortly thereafter, the press cylinder 53, as described above, comes to press the recording tape 20 onto the elastic plate 19. During the movement of the printing block 28, the detector 71 fixed on this block displaces along the encoder board 70 and furnishes a pulse each time it travels past one of the lines (or slits) on this board. The pulses delivered in succession by the detector 71 are applied, as shown in FIG. 9B, to the conditioned input of the control circuit C11. Because this circuit C11 is conductive, these pulses are transmitted by this circuit and are applied, via the OR circuits U1, U2, . . . , Un, to the inputs of the shift registers RD1, RD2, . . . , RDn; each pulse so applied thus causes the binary numbers contained in these ten groups of registers to shift one position to the right. If the last position Jp (that is, the one located the farthest to the right in FIG. 9B) of one of these registers contains a binary number 1 at the instant when a pulse is applied to the input of this register, then as a consequence of the shifting thus effected this binary number 1 is extracted from this register in the form of a pulse, which when appied to the winding of the head associated with this register causes a magnetized point to appear on the surface of the recording tape 20. It will thus be appreciated that in the course of the displacement of the carriage 35 and printing block 28, the n windings A1, A2, . . . , An of the magnetic recording heads are excited selectively, such that the latent magnetic images required for printing ten lines of characters come to be recorded onto the tape 20 in the course of the displacement of these heads. As the printing block 28 is displaced, these latent images are coated with a layer of powdered developer and then form images in powder which are transferred onto the strip of paper 11 at the moment when they are pressed against this strip 11 by the action of the press cylinder 53.

The displacement of the carriage 35 and printing block 28 in the direction of the arrow A continues until the moment that this block presses in the contact 46. At that moment, a continuous current beginning at +48 volts circulates as shown in FIG. 9C via the closed contacts CBO4 and CBO5 and via the pressed-in contact 46, and excites or energizes the two relays BO2 and BO6. This same continuous current charges the capacitor C via the didoe D2. Furthermore, this continuous current is applied to the input of a shunt amplifier AD, of a known type, which is arranged such that it furnishes a single electrical pulse at its output each time its input is connected to a positive potential. The pulse which is thus delivered by the shunt amplifier is then applied to the input of a control device DAP, which in response to this pulse, after a slight delay, triggers the advancement of the strip of paper 11 by a length corresponding to the portion that has been printed; this enables an unprinted portion of this strip to be placed beneath the recording tape 20. Thus, as FIGS. 9A, 9B and 9C show, the pulse which is delivered by the shunt amplifier AD is also sent to the central unit UC, via a conductor FIP. This pulse comprises a signal which enables warning the central unit UC of the end of the displacement of the carriage 35 and printing block 28 in the direction of the arrow A. As soon as it receives this pulse, the central unit UC can then control all the operations making it possible to reload the ten groups of shift registers. This reloading is necessary so that ten more lines of characters can be printed. These operations will accordingly not be described here in further detail, because they are analogous to those already described above.

Thus as noted above, pressing in the contact 46 by the printing lock 28 causes the excitation of the relays BO2 and BO6, such that the excited relay BO6 flips its contact CBO6 over into its operating position. Pressing in the contact 46 also has the effect of interrupting the supply to the relay BO1 and making the control circuit C11 non-conductive. The relay BO1, no longer excited, then opens its contact CBO1, such that the winding M2 of the motor 42 ceases to be supplied with alternating current. Meanwhile, the relay BO2, which is kept in the excited state, closes its contact CBO2 and thus enables the winding M1 to be supplied with the alternating current furnished by the terminals 220 MN. Under these conditions, the motor 42 beings to turn in the opposite direction, and thus causes the carriage 35 and the printing block 28 to move in the direction indicated by the arrow R in the drawings. Because of being so driven, the printing block 28 returns to its position of rest and then frees the contact 46, which stands out again. Thus as FIG. 9C shows, a continuous current now circulates, beginning at +48 volts, via the closed contacts CBO4 and CBO5 between the contact 46, which is not pressed in, and the change-over contact CBO6 in its operating position and thus continues to excite the relays BO2 and BO6. It should be noted that at the moment that the contact 46 stands out once again, the electrical circuit which, beginning at +48 volts, enables the exiting of the relays BO2 and BO6 is interrupted for a very short period of time, which corresponds to the passage from the pressed-in position of the contact 46 to the non-pressed-in position of this contact. In any case, during this period of time the excitation of the relays BO2 and BO6 is maintained by the discharge, via the resistor R, of the capacitor C, which is connected in parallel with these relays BO2 and BO6. Under these conditions, the change-over contact CBO6 cannot flip over into its position of rest when the contact 46 resumes its non-pressed-in position. It should also be noted that the discharge of the capacitor C prevents the input of the shunt amplifier AD from being momentarily without voltage, so that no pulse at all is sent by this shunt amplifier at the moment when the contact 46 returns to its non-pressed-in position.

It should be remembered that when the printing block 28 is displaced in the direction of the arrow R in order to return to its position of rest, the press cyinder 53 stops pressing the recording tape 20 onto the strip of paper 11, so that the advancement of the strip of paper mentioned above is commanded by the control device DAP at the instant when this printing block returns to its position of rest. The displacement of the carriage 35 and printing block 28 thus continues until the instant when this block, reaching its position of rest, pushes in the contact 47 once again. At this instant, as shown in FIG. 9C, a continuous current circulates between the non-pressed-in contact 46, the change-over contact CBO6 in its operating position, and the pressed-in contact 47, via the closed contacts CBO4 and CBO5, and causes the excitation of the relay BO4. The excited relay BO4 then opens its contact CBO4 and interrupts the excitation to the relay coils BO5, BO2, BO6 and BO4. The deenergized relay BO5 opens its contact CBO5. The deenergized relay BO2, opens its contact CBO2, thus interrupting the excitement, with alternating current, of the winding M1 of the motor 42. Under these conditions, the motor 42 stops. The deenergized relay BO6, flips its contact CBO6 over into a position of rest. Finally the relay BO4, also no longer excited, closes its contact CBO4. Meanwhile, because the contact CBO5 is kept open, none of the relays BO1, BO2, BO4, BO5 and BO6 can be excited and the electrical circuits shown in FIG. 9C are in the state in which they were at the outset.

It should also be noted in connection with FIGS. 9A, 9B and 9C that when the printing block 28 reaches its position of rest and once again presses the contact 47 in, the continuous current which then begins to excite the relay BO4 is also sent to the central unit UC, via a conductor FDC. This current accordingly comprises a signal which serves to warn the central unit UC that the printing block 28 has returned to its position of rest. Then, once it has both received this signal and completed the operations of loading the registers RD1, RD2, . . . , RDn, the central unit UC can send a new pulse via its conductor CDC so as to trigger the printing of ten new lines of characters onto the strip of paper 11.

It should be noted that in the exemplary embodiment that has been described above, the average speed of displacement of the carriage 35 and of the printing block 28 is about one meter per second, and that the length of the path traversed by this printing block in moving from the contact 47 to the contact 46 is on the order of 30 centimeters. Under these conditions, the printing block 28 and the carriage 35 make one round trip in about 600 milliseconds. Since in this period of time, ten lines of characters are printed on the strip of paper 11, the printing apparatus just described is capable of printing characters at a speed in the neighborhood of 1000 lines of characters per minute. This kind of printing rate, which is quite suitable when the characters to be printed are sent at a relatively slow rate by the central unit UC, that is, not exceeding about 1000 characters per second, may nevertheless prove inadequate when the rate increases, for instance to 1500 characters per second. Nevertheles this disadvantage can be overcome in various ways. A first way is to modify the printing apparatus described above so that it can be used in cooperation with a recording tape 20 which is larger in width than the tape of the apparatus just described above.

Figure 8:
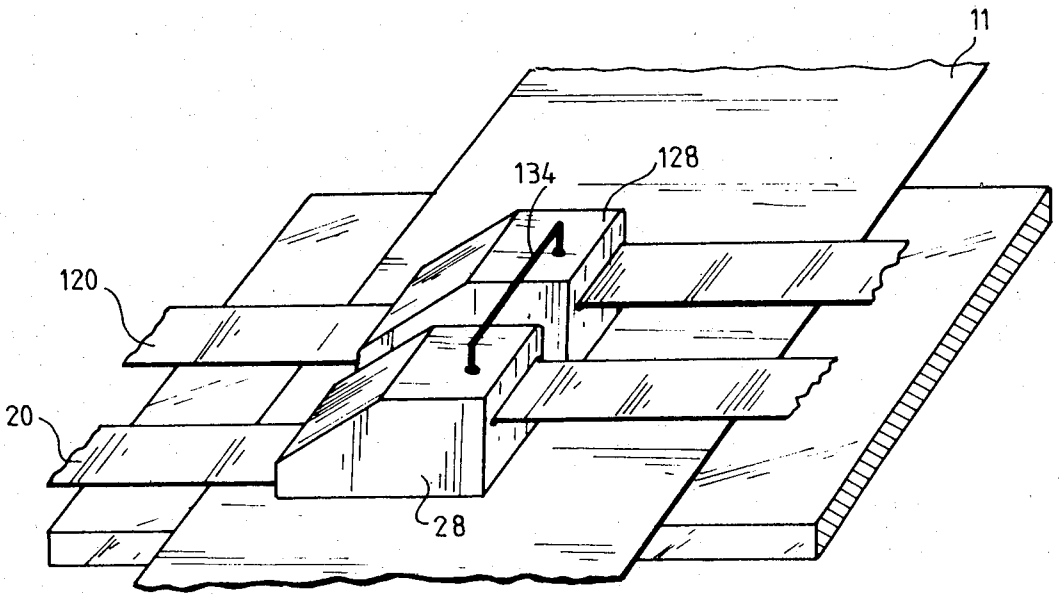
FIG. 8 is a schematic view, in perspective, showing how the printing apparatus shown in FIG. 1 can be adapted to effect printing in colors onto a print carrier.

It is useful to note that for simultaneous printing of ten lines of characters, the recording tape 20 has a width practically equal to six centimeters. A second way, which has been shown schematically in FIG. 8, is to provide multiple recording tapes, two for example, 20 and 120, placed parallel to one another, and corresponding associated printing blocks 28 and 128, each of which is displaced respectively along each of the tapes 20 and 120. The two blocks are analogous in structure to that shown in FIG. 2 and are fixed solidly to one another by a connecting piece 134, which may advantageously comprise a shaft that assures the articulation of the printing blocks 28 and 128 on one and the same carriage 35 (not shown in FIG. 8). The embodiment shown in FIG. 8 also proves to be still more advantageous because is capable of printing different colors of characters on the strip of paper 11, because the color of the developer located in the printing block 28 need not be the same as that of the developer in the printing block 128.

Figure 7:
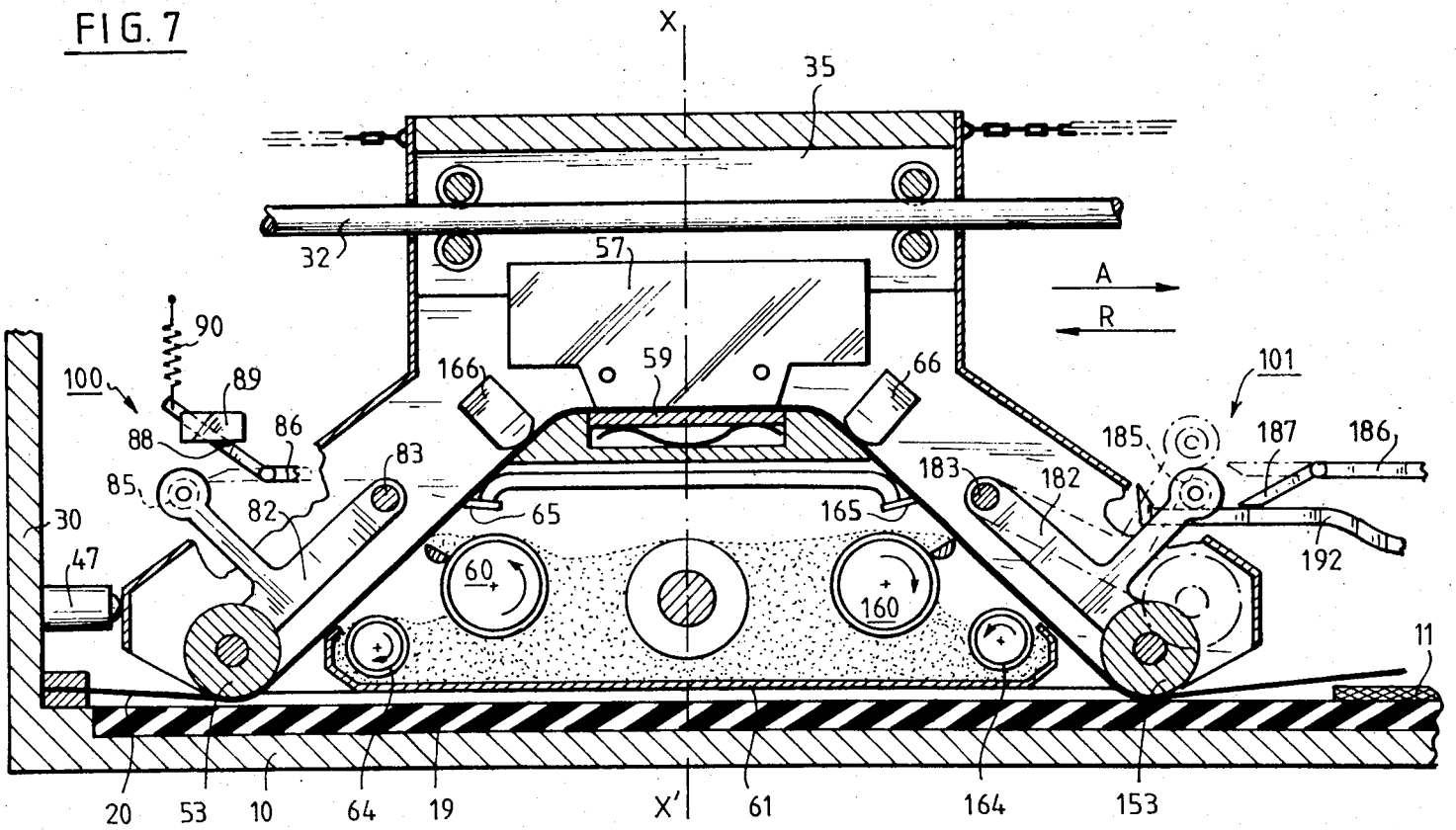
FIG. 7 is a schematic sectional view of a third exemplary embodiment of a printing apparatus according to the invention.

The printing apparatus shown in section in FIG. 7 illustrates a third way to increase the printing rate, by utilizing merely one recording tape 20 having the same width as that in the apparatus shown in FIG. 1. The apparatus of FIG. 7 comprises a single box joined to a carriage 35, which is capable of sliding on guide rods 32 and 33. These rods, only one, 32, of which is visible in the sectional view of FIG. 7, are similar to those shown in FIG. 1. On the inside of the box, there are devices analogous to those shown in FIG. 2, which for that reason have been assigned the same reference numerals in both FIGS. 2 and 7. Thus FIG. 7 shows the device 57 for recording latent images on the recording tape 20, the applicator device 60 which enables the powdered developer contained in the reservoir 61 to be deposited onto these images, the retouching device 64 intended for eliminating excess particles of the developer, the transfer device comprising the press cylinder 53, the cleaning device comprising the scraper 65, and the erasing device 66. Also disposed on the inside of the box are a second applicator device 160, a second retouching device 164, a second transfer device comprising a press cylinder 153, a second cleaning device comprising a scraper 165, and a second erasing device 166. As FIG. 7 shows, the devices performing analogous functions, such as the two applicator devices 60 and 160, for example, are located in symmetrical positions with respect to a vertical axis of symmetry X—X'. An actuating mechanism in two parts 100 and 101 controls the press cylinders 53 and 153 so as to enable them in turns to press the recording tape 20 against the plate 19 and the strip of paper 11. To this end, as shown in FIG. 7, the press cylinder 53 is freely supported on a shaft that is fixed to the end of a lever 82 which at its other end is articulated about a shaft 83 joined to the box. Similarly, the press cylinder 153 is freely supported on a shaft fixed to the end of a lever 182 which at its other end is articulated about a shaft 183 fixed to the box. A roller 85, supported by the lever 82, by rolling on the upper or lower edge of a rail 86 enables the raising or lowering of the lever 82 and thus enables keeping the press cylinder 53 spaced apart from the elastic plate 19 or, contrarily, enables urging it downward so as to press the recording tape 20 onto this plate. In like manner, a roller 185 supported by the lever 182 makes it possible by rolling on the upper or lower edge of a rail 186, to raise or lower the lever 182 and thus keep the press cylinder 153 either spaced apart from the elastic plate 19 or urged downward toward it so as to press the recording tape 20 onto this plate. Since the box is at rest in its extreme left-hand position as shown in FIG. 7, that is, near the upright member 30, it will be appreciated that when this box is driven by the carriage 35 in the direction indicated by the arrow A, in the course of this displacement the roller 185 comes into contact with the upper surface of an upwardly inclined ramp 187, which since it is articulated at the left-hand end of the rail 186 and normally rests on the upper edge of a slide 192, as shown in the drawing compels the roller 185 to roll on the upper edge of the rail 186, such that the lever 182 is moved into the position represented by dot-dash lines and also keeps the press cylinder 153 at a distance from the plate 19. Contrarily, in the course of this same displacement, the roller 82 comes into contact with the lower surface of a downwardly inclined ramp 88, as shown in the drawing; this ramp is articulated at the left-hand end of the rail 86 and is normally pressed against a stop 89 under the influence of a traction spring 90 and so compels the roller 85 to slide on the lower edge of the rail 86, such that the lever 82 lowers the press cylinder 53 so as to enable it to press the tape 20 against the plate 19. When the box arrives near its extreme right-hand position, the roller 85 raises an inclined ramp, which analogously to the ramp 187 is articulated at the right-hand end of the rail 86. This ramp drops as soon as the roller 85 has traveled beneath it and thus compels this roller, once the box is displaced in the opposite direction or in other words in the direction of the arrow R, to roll over the upper edge of the rail 86, such that the cylinder 53 is kept spaced apart from the plate. As the box continues its displacement in the direction of the arrow R, when the box is just about to reach its extreme left-hand position, this roller 85 comes to lower the ramp 88 and thus passes between this ramp 88 and the stop 89. Once this passage has been completed, the ramp 88 rises again and resumes its normal position against the stop 89. Likewise, an inclined ramp which analogously to the ramp 88 is articulated on the right-hand end of the rail 186 enables the roller 185 to roll on the lower edge of the rail 186 once the box is displaced in the direction of the arrow R, such that the tape 20 is then pressed against the plate 19 by the press cylinder 153. It should be noted that when the box is displaced in the direction of the arrow A, the erasing device 166 remains inactive, and the cylinders of the devices 160 and 164 are prevented from rotating by known means (not shown), while the erasing device 66 is activated. Under these conditions, the former latent images which have remained on the recording tape 20 are now erased, at the moment when they travel past the device 66; this enables the recording device 57 to record new latent images on this tape, and these new latent images give way in turn to new images formed in powder. In addition, in the course of this same displacement, the tape 20, as has been seen above, is pressed onto the plate 19 by the press cylinder 53, which is now located upstream of the recording device 57 in terms of the direction of displacement A. Because of this pressure, these new powder images are now transferred onto the strip of paper 11, which is positioned on the plate 19. In like manner, when the box is displaced in the direction of the arrow R, the erasing device 66 is made inactive, and the cylinders of the devices 60 and 64 are prevented from rotating by known means (not shown), while the erasing device 166 is activated. Under these conditions, the latent images which have been recorded by the device 57 in the course of this displacement are replaced by powder images. Because in the course of this displacement the tape 20 is pressed onto the plate 19 by the press cylinder 153, these powder images are in turn transferred onto the strip of paper 11. It will be appreciated that under these conditions the strip of paper 11 is imprinted once during each of the displacements of the box. Naturally, this strip 11 is displaced each time the box has arrived at one or the other of the two ends of its path, which prevents already-printed portions of this strip from being printed over once again. It will also be appreciated that when the box is displaced in the direction of the arrow R, the press cylinder which presses the tape 20 onto the plate 19 is the press cylinder 153, that is, the one which is located upstream of the recording device 57 in terms of the direction of displacement R.

Figure 6:
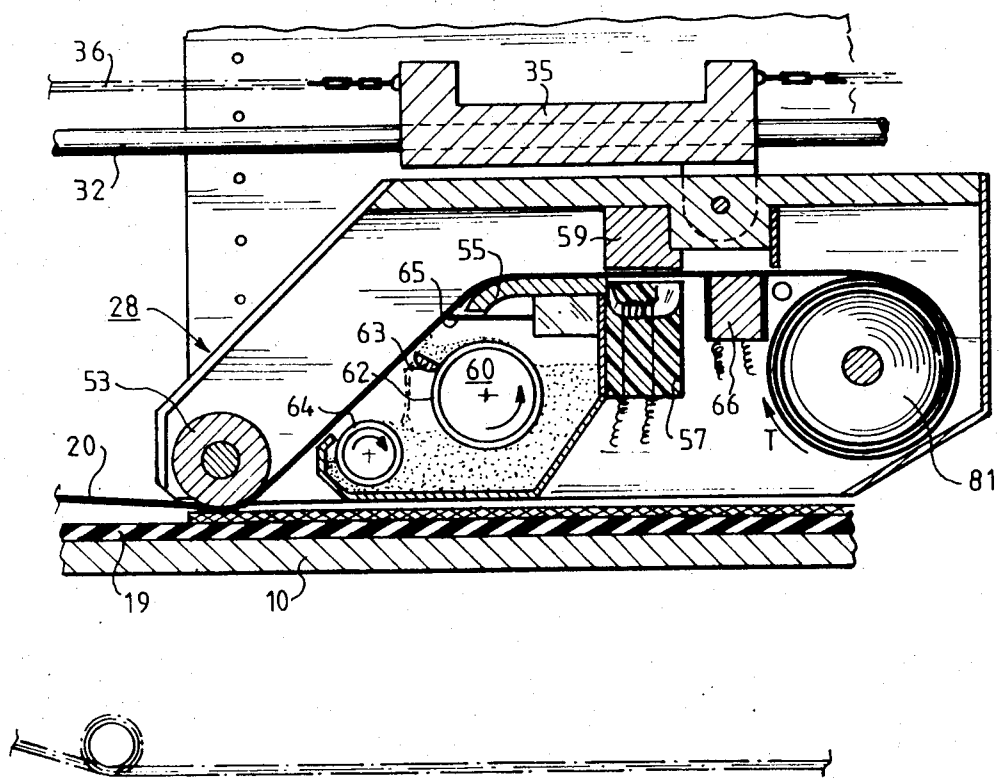
FIG. 6 is a schematic sectional view of a second exemplary embodiment of a printing apparatus according to the invention.

The recording tape 20 can be kept slightly taut by other means than those shown in FIG. 1. For example, in the embodiment shown in FIG. 6, the tape 20 is held taut by a tensioning drum 81, which is housed in the interior of the box. The tape 20, the end 24 of which is attached to this drum, is wound partway around this drum, as shown in the drawing, and the tension of the tape is assured by known means, such as a spiral spring, for example, which urge the drum to rotate in the direction T such that the tape 20 tends to become wound onto this drum.

It will be understood that the invention is not limited to the exemplary embodiments described and shown herein, which are given solely by way of example. On the contrary, the invention encompasses any means which are technologically equivalent to those described and shown herein, whether taken in isolation or in combination, and is defined by the scope of the appended claims to which reference should be made for an appreciation and understanding of the full scope of this invention.

What is claimed is:

1. A non-impact printing apparatus comprising at least one flexible recording carrier (20) provided with a surface for recording latent images, at least one recording device (57) cooperating with the recording carrier to form a latent image on the said surface, at least one applicator device (60) arranged for depositing particles of developer onto said surface, said particles remaining applied only on this latent image in order to form an image in powder, and at least one transfer device (53) for transferring said image in powder onto a print carrier (11), said flexible recording carrier (20) having at least one end (21) fixed with respect to the surface of a stationary support element (10) on which said print carrier (11) is positioned, said recording carrier (20) being taut at least between said recording device (57) and said end (21) of the recording carrier, and said recording device (57), applicator (60) and transfer device (53) being displaced along said recording carrier (20) to form an image in powder upon said recording carrier (20) and transfer said image onto the print carrier (11), and said transfer device (53) being displaceable across the print carrier and having a presser element (53) disposed such that in course of displacement of the transfer device, presser (53) assures that the recording carrier (20) and the print carrier (11) are put in contact with each other.

2. A printing apparatus according to claim 1, wherein said recording device (57), applicator device (60) and transfer device (53) are housed in the same unit, forming a printing block (28), said block being arranged for displacement along a direction (A, R) parallel to the surface of the support element (10).

3. A printing apparatus according to claim 2, wherein the printing block (28) is arranged for displacement along the recording carrier (20) on a rectilinear path limited by two stops (46 and 47) and includes an actuating mechanism (100) arranged so as, first, to enable the presser element (53) to press the recording carrier (20) onto the print carrier (11) when said printing block is driven in a direction along said path, and so as, second, to prevent said presser element from pressing the recording carrier onto the print carrier when said block is driven in the opposite direction.

4. A printing apparatus according to claim 3, wherein the recording device (57) includes n recording elements (58) controlled by electric pulses, each being arranged so as to form on the recording carrier (20), in response to these pulses, a sensitized point which is a constituent of a latent image, the sensitized points of this image being disposed in a matrix of n lines and p columns, this apparatus further including:

a group of n shift registers (RD1, RD2, . . . , RDn) each associated with a respective one of said n recording elements, each register including p storage positions (J1, J2, . . . , Jp) each arranged to temporarily contain one data bit required to control the formation of a sensitized point;

a data bit generator (GBI) connected to the inputs of these registers so that upon being commanded it sends combinations of bits intended to be recorded in said storage positions;

a control signal source (71) connected to the inputs of these registers so as to send them, upon the displacement of the printing block (28), signals causing the extraction, one position at a time, of the data bits contained in these registers, the bits thus extracted being sent in the form of electric pulses to the recording elements (58);

and validating means (C1) disposed between said signal source (71) and said registers, and arranged to authorize the transmission to these registers of the control signals furnished by said source (71) only when the printing block (28) is driven in the direction enabling the presser element (53) to press the recording carrier (20) onto the print carrier (11).

5. A printing apparatus according to claim 1, wherein the recording carrier (20) is held taut by at least one traction spring (27) disposed between the outer end (24) of this recording carrier (20) and a fixed piece (31) attached to the support element (10) of the apparatus.

6. A printing apparatus according to claim 2, wherein the recording carrier (20) is held taut by at least one traction spring (27) disposed between the outer end (24) of this recording carrier (20) and a fixed piece (31) attached to the support element (10) of the apparatus.

7. A printing apparatus according to claim 3, wherein the recording carrier (20) is held taut by at least one traction spring (27) disposed between the outer end (24) of this recording carrier (20) and a fixed piece (31) attached to the support element (10) of the apparatus.

8. A printing apparatus according to claim 4, wherein the recording carrier (20) is held taut by at least one traction spring (27) disposed between the outer end (24) of this recording carrier (20) and a fixed piece (31) attached to the support element (10) of the apparatus.

9. A printing apparatus according to claim 1, wherein the recording carrier (20) is held taut by a tensioning drum (81) about which, after the other end (24) of said recording support (20) has been fixed, said recording support is partially wound.

10. A printing apparatus according to claim 2, wherein the recording carrier (20) is held taut by a tensioning drum (81) about which, after the other end (24) of said recording support (20) has been fixed, said recording support is partially wound.

11. A printing apparatus according to claim 3, wherein the recording carrier (20) is held taut by a tensioning drum (81) about which, after the other end (24) of said recording support (20) has been fixed, said recording support is partially wound.

12. A printing apparatus according to claim 4, wherein the recording carrier (20) is held taut by a tensioning drum (81) about which, after the other end (24) of said recording support (20) has been fixed, said recording support is partially wound.

13. A printing apparatus according to claim 2, wherein the printing block (28) contains two presser elements (53 and 153) disposed one on each side of the recording device (57) and is arranged to be displaced along the recording carrier (20) on a rectilinear path limited by two stops (46 and 47) and further includes an actuating mechanism (100, 101) arranged, first, to enable only one of the presser elements to press the recording carrier (20) onto the print carrier (11) when said printing block is driven in a direction along said path, and, second, to enable only the other of the presser elements to press the support carrier onto the print carrier when said block is driven in the opposite direction, the presser element effecting this pressure being the one which is located upstream, with respect to the direction in which the printing block is being driven, of the recording device (57).

14. A printing apparatus according to claim 1, wherein the recording carrier (20) comprises a magnetic recording tape.

15. A printing apparatus according to claim 2, wherein the recording carrier (20) comprises a magnetic recording tape.

16. A printing apparatus according to claim 3, wherein the recording carrier (20) comprises a magnetic recording tape.

17. A printing apparatus according to claim 4, wherein the recording carrier (20) comprises a magnetic recording tape.

18. A printing apparatus according to claim 1, wherein the point where the fixed end (21) of the recording carrier is attached is located in proximity to the surface of the support element (10).

19. A printing apparatus according to claim 2, wherein the point where the fixed end (21) of the recording carrier is attached is located in proximity to the surface of the support element (10).

20. A printing apparatus according to claim 3, wherein the point where the fixed end (21) of the recording carrier is attached is located in proximity to the surface of the support element (10).

21. A printing apparatus according to claim 4, wherein the point where the fixed end (21) of the recording carrier is attached is located in proximity to the surface of the support element (10).

* * * * *